US006350726B1

(12) United States Patent
Gorlin et al.

(10) Patent No.: US 6,350,726 B1
(45) Date of Patent: Feb. 26, 2002

(54) SPECKLED POWDERED AUTOMATIC DISHWASHING COMPOSITION

(75) Inventors: Philip Gorlin, Flemington; Steve Phillips, Highland Park; James Cush, Washington Township, all of NJ (US)

(73) Assignee: Colgate Palmolive Company, New York, NY (US)

( * ) Notice: Subject to any disclaimer, the term of this patent is extended or adjusted under 35 U.S.C. 154(b) by 0 days.

(21) Appl. No.: 09/940,024

(22) Filed: Aug. 27, 2001

(51) Int. Cl.[7] ..... C11D 3/22

(52) U.S. Cl. ..... 510/220; 510/224; 510/226; 510/231; 510/232; 510/233

(58) Field of Search ..... 510/220, 224, 510/226, 231, 233, 232

(56) References Cited

U.S. PATENT DOCUMENTS 3,816,320 A * 6/1974 Corliss ..... 252/99
3,951,838 A * 4/1976 Jayawant et al. ..... 252/99
6,221,820 B1 * 4/2001 Lietzmann et al. ..... 51/224

* cited by examiner

*Primary Examiner*—Necholus Ogden
(74) *Attorney, Agent, or Firm*—Richard E. Nanfeldt

(57) ABSTRACT

The present invention relates to a speckled powdered automatic dishwashing composition.

7 Claims, No Drawings

SPECKLED POWDERED AUTOMATIC DISHWASHING COMPOSITION

FIELD OF THE INVENTION

The present invention relates to a speckled powdered automatic dishwashing composition containing a uniform mixture of a noncolored agglomerate of powdered automatic dishwashing composition and a colored agglomerate of powdered automatic dishwashing composition.

BACKGROUND OF THE INVENTION

The automatic dishwashing market in the U.S. is led by powdered detergents, which make up 50% of all detergents sold. Two variants are generally marketed: lemon and fresh scent, and the detergents are typically white granular powders made by a wet agglomeration process. In some cases, speckles are added to enhance the visual appearance and support the aesthetic claims. Typically, the speckles are added as a pre-colored raw material such as phosphate or carbonate. If enzymes are used in the formulation, colored enzymes can be added, although typical enzyme levels in powders are less than 3%, limiting the level of speckles. A disadvantage of adding pre-colored granules as described above is that the particle size distribution of the speckles is very narrow, and when combined with an agglomerated detergent base with broad particle size distribution, the potential for segregation is increased. This is undesirable, since the colored speckles will not mix evenly with the white powder, leading to an uneven distribution of the speckles in the powdered product, which can impact the performance and aesthetics negatively.

SUMMARY OF THE INVENTION

The present invention relates to an automatic dishwashing cleaning system comprising a agglomerate of noncolored powdered automatic dishwashing agglomerate composition and a colored powdered automatic dishwashing agglomerate composition.

In this invention, a speckled detergent powder is made in which the speckled colored particles possess the same particle size distribution as the uncolored base particles. This is accomplished by coloring a portion of the agglomerated base and mixing it with the uncolored agglomerate base. A further aspect of this invention is the formulating of pink and green speckles into a powdered dishwashing detergent to make aesthetically pleasing products.

DETAILED DESCRIPTION OF THE INVENTION

The present invention relates to a speckled powdered automatic dishwashing composition comprising approximately by weight a mixture of:

(a) 85% to 99% of noncolored agglomerate particles which comprise:
  (i) 15% to 25% of a first alkali metal phosphate builder salt;
  (ii) 2% to 12% of a first alkali metal disilicate;
  (iii) 35% to 45% of a first nonphosphate detergent builder salt;
  (iv) 25% to 35% of a first alkali metal sulfate; and
  (v) 0.5% to 2.5% of a first ethoxylated nonionic surfactant; and (b) 1% to 15% of colored agglomerate particles which comprise:
  (i) 0.05% to 0.75% of a colorant;

(ii) 15% to 25% of a second alkali metal phosphate builder salt;
  (iii) 2% to 12% of a second alkali metal disilicate;
  (iv) 35% to 45% of a second nonphosphate detergent builder salt;
  (v) 25% to 35% of a second alkali metal sulfate; and
  (v) 0.5% to 2.5% of a second ethoxylated nonionic surfactant.

Excluded from the instant compositions are anionic surfactants, fatty acid or alkali metal salts of fatty acid, crosslinked polyacrylate polymers and more than 10 wt. % of water.

The first or second nonionic surfactants that can be used in the present powdered automatic dishwasher detergent compositions are generally described as ethoxylated/propoxylated fatty alcohols which are low-foaming surfactants and may be possibly capped, characterized by the presence of an organic hydrophobic group and an organic hydrophilic group and are typically produced by the condensation of an organic aliphatic or alkyl aromatic hydrophobic compound with ethylene oxide and/or propylene oxide (hydrophilic in nature). Practically any hydrophobic compound having a carboxy, hydroxy, amide or amino group with a free hydrogen attached to the oxygen or the nitrogen can be condensed with ethylene oxide or propylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Preferably, the nonionic surfactants that are used are the low-foaming polyalkoxylated lipophiles wherein the desired hydrophile-lipophile balance is obtained from addition of hydrophilic poly-lower alkoxy group to a lipophilic moiety. A preferred class of the nonionic detergent employed is the poly-lower alkyoxylated higher alkanol wherein the alkanol is of 9 to 18 carbon atoms and wherein the number of moles of lower alkylene oxide (of 2 or 3 carbon atoms) is from 3 to 15. Of such materials, it is preferred to employ those wherein the higher alkanol is a high fatty alcohol of 9 to 11 or 12 to 15 carbon atoms and which contain from 5 to 15 or 6 to 16 lower alkoxy groups per mole. Preferably, the lower alkoxy is ethoxy but in some instances, it may be desirably mixed with propoxy, the latter, if present, usually being major (more than 50%) portion. Exemplary of such compounds are those wherein the alkanol is of 12 to 15 carbon atom and which contain about 7 ethylene oxide groups per mold.

Useful nonionics are represented by the low foam Plurafac series from BASF Chemical Company which are the reaction product of a higher linear alcohol and a mixture of ethylene and a propylene oxides, containing a mixed chain of ethylene oxide and propylene oxide, terminated by a hydroxyl group. Examples include Product A (a $C_{12}$–$C_{15}$ fatty alcohol condensed with 6 moles ethylene oxide and 3 moles propylene oxide). Product B (a $C_{12}$–$C_{15}$ fatty alcohol condensed with 7 mole propylene oxide and 4 mole ethylene oxide), and Product C (a $C_{12}$–$C_{15}$ fatty alcohol condensed with 5 moles propylene oxide and 10 moles ethylene oxide). Another group of liquid nonionics are available from Shell Chemical Company, Inc. under the Dobanol trademark: Dobanol 91-5 is a low foam ethoxylated $C_2$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide. Another liquid nonionic surfactant that can be used is sold under the tradename Lutensol SC 9713.

Plurafac nonionic surfactants from BASF are biodegradable, low-foaming surfactant which are specially preferred for the instant automatic dishwashing compositions. Plurafac™ SLF18 which is water dispensible and has a low surface tension and low cloud and is low foaming is especially preferred for use in the instant automatic dishwashing compositions.

Other useful surfactants are Neodol 25-7 and Neodol 23-6.5, which products are made by Shell Chemical Company, Inc. The former is a condensation product of a mixture of higher fatty alcohols averaging about 12 to 13 carbon atoms and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted.

The first and second alkali metal phosphate detergent builder salts used in the instant composition include the polyphosphates, such as alkali metal pyrophosphate, alkali metal tripolyphosphate, alkali metal metaphosphate, and the like, for example, sodium or potassium tripolyphosphate (hydrated or anhydrous), tetrasodium or tetrapotassium pyrophosphate, sodium or potassium hexa-metaphosphate, trisodium or tripotassium orthophosphate and the like. Sodium tripolyphosphate is more preferred. The alkali metal nonphosphate detergent builder salts include sodium or potassium carbonate, sodium or potassium citrate, sodium or potassium nitrilotriacetate, and the like, wherein sodium carbonate is preferred.

The first or second silicate compound which is an alkali metal silicate compound is useful as anti-corrosion agents in the composition and these compounds function to make the composition anti-corrosive to eating utensils and to automatic dishwashing machine parts. The alkali metal silicates such as sodium silicates of $Na_2O:SiO_2$ have ratios of from 1:1 to 1:2.4. Potassium silicates of the same ratios can also be used. The preferred silicates used at a concentration of 4% to 16%, more preferably 6% to 12% are selected from the group consisting dialkali metal silicates and alkali metal silicates and mixtures thereof.

The first or second alkali metal sulfate used in the instant composition is preferably sodium sulfate.

A chlorine bleach which can be optionally used at a concentration of 0.1 wt. % to 4 wt. % in the instant composition is selected from the group of sodium dichloroisocyanurate, clichloro-dimethyl hydantoin and chlorinated TSP and mixtures thereof.

The detergent formulation also can optionally contain a mixture of a protease enzyme and an amylase enzynie and, optionally, a lipase enzyme that serve to attack and remove organic residues on glasses, plates, pots, pans and eating utensils. Lipolytic enzymes can also be used in the automatic dishwashing composition. Proteolytic enzymes attack protein residues, lipolytic enzymes fat residues and amylolytic enzymes starches. Proteolytic enzymes include the protease enzymes subtilisn, bromelin, papain, trypsin and pepsin. Amylolytic enzymes include amylase enzymes. Lipolytic enzymes include the lipase enzymes. The preferred amylase enzyme is Termamyl 300L, Type DX having an activity of 300 KNU/g. It is an alpha amylase prepared by submerged fermentation of a selected strain of Bacillius liceniformis.

A preferred protease enzyme is Savinase 16. OL Type, Ex sold by Novo. It has an actively of 16. KNPU/g and is prepared by submerged fermentation of an alcalophilic strain of Bacillus. Another useful protease enzyme is Durazym 16.0 L Type Ex which is sold by Novo and has an activity of 16 DPU/g. It is a protein-engineered variant of Savinase.

Other conventional ingredients may be included in the instant compositions in small amounts, generally less than about 3 weight percent, such as perfume, hydrotropic agents such as the sodium benzene, toluene, xylene and cumene sulphonates, preservatives, dyestuffs and pigments and the like, all of course being stable to bleach compound and high alkalinity.

The red colorant used in the first composition is a red azo dye manufactured by Clariant under the tradename of Drimarene Brillant Red R/K 48L CDGGR and is a C.I. Reactive Red 147 dye. The yellow colorant is manufactured by Ciga-Geigy under the tradename Vibracolor Yellow PYE-13-L pigment and is a diarylide-m-xylidide and comprises 30 to 40 wt. % of diarylide-m-xyledine yellow pigment, 1 to 10 wt. % of alcohol ethoxylate, 1 to 10% of a sodium salt of 2-napthalene sulfonic acid polymer with the formaldehyde and 0.1% to 1% of tributyl phosphate. The green colorant is a phthalocyanine green pigment manufactured by Clariant under the tradename Graphtol Green 5869-3 and is a C.I. pigment green 7, C.I. 74260.

The colored agglomerated particles are produced using a suitable mixing device which:

(a) continuously exposes fresh surface area of the desired product to a dye solution overspray;

(b) causes the oversprayed product to continuously contact undyed product to facilitate dye color transference;

(c) minimizes additional granulation by minimizing the amount of dye solution needed to color the desired product; and (d) minimizes color variability by slowly overspraying the dye solution. The minimizes the color gradients which would occur under rapid overspray application and maximizes the time for dye color transference. Many mixing devices (batch or continuous) can accomplish the requirements listed above. The specific mixing device used in this application was a batch rotary drum. The overspray dye solution was applied to the entire autodish agglomerate (without chlorine bleach, perfume or processing aid adjuncts).

The invention may be put into practice in various ways and a number of specific embodiments will be described to illustrate the invention with reference to the accompanying examples.

All amounts and proportions referred to herein are by weight of the composition unless otherwise indicated.

EXAMPLE 1

The following formulations were prepared as described below:

A pink solution (S-1) was prepared by simple mixing:

| | wt. % |
|---|---|
| Deionized water | 99.7 |
| Drimarene Brilliant Red R/K-4BL CDG-BR (Clariant) | 0.3 |

A green solution (S-2) was prepared by simple mixing:

| | wt. % |
|---|---|
| Deionized water | 98.98 |
| Vibracolor Yellow PYE13-L (Ciba) | 0.74 |
| Graphtol Green 5869-3 (Clariant) | 0.28 |

An uncolored base formula (Base A) was prepared by an agglomeration

| | wt. % |
|---|---|
| Sodium tripolyphosphate (15.8% $H_2O$) | 19.33 |
| Sodium disilicate (47.5% active) | 13.84 |
| Sodium carbonate (FMC 100) | 37.4 |
| Sodium sulfate | 28 |
| Nonionic surfactant (Plurafac SLF-18) | 1.3 |

A portion of the agglomeration base (Base A) was colored with the pink colored solution (S-1) and the green colored solution 2 to form a pink colored speckled base Base P) and a green colored speckled base (Base G)

| | Pink base (Base P) | Green base (Base G) |
|---|---|---|
| Agglomerated Base A | 94.3 | 97 |
| Pink color solution (S-1) | 5.7 | |
| Green color solution (S-2) | | 3 |

The speckled powdered automatic dishwashing compositions were prepared by blending the uncolored Base-A with either the colored Base-P or colored Base-G as well as sodium dichloroisocyanurate and fragrance.

| | Example 1 % | Example 2 % | Example 3 % |
|---|---|---|---|
| Uncolored agglomerated base (Base A) | 93.25 | 88.3 | 93.3 |
| Pink speckles (Base P) | 5 | 10 | |
| Green speckles (Base G) | | | 5 |

-continued

| | Example 1 % | Example 2 % | Example 3 % |
|---|---|---|---|
| Sodium dichloroisocyanurate (CDB-56) | 1.5 | 1.5 | 1.5 |
| Fragrance | 0.25 | 0.2 | 0.2 |

What is claimed:

1. A speckled powdered automatic dishwashing composition comprising approximately by weight a mixture of:

(a) 85% to 99% of noncolored agglomerated particles of:

(i) 15% to 25% of a first alkali metal phosphate detergent builder salt;

(ii) 2% to 12% of a first alkali metal disilicate compound;

(iii) 35% to 45% of a first alkali metal nonphosphate detergent builder salt;

(iv) 25% to 35% of a first alkali metal sulfate; and (v) 0.5% to 2.5% of a first ethoxylated nonionic surfactant; and (b) 1% to 15% of colored agglomerated particles of:

(i) 0.05% to 0.75% of a mixture of a green pigment and a yellow pigment;

(ii) 15% to 25% of a second alkali metal phosphate builder salt;

(iii) 2% to 12% of a second alkali metal disilicate;

(iv) 35% to 45% of a second alkali metal carbonate;

(v) 25% to 35% of a second alkali metal sulfate; and (v) 0.5% to 2.5% of a second ethoxylated nonionic surfactant wherein excluded from the instant compositions are anionic surfactants, fatty acid or alkali metal salts of fatty acid, crosslinked polyacrylate polymers and more than 10 wt. % of water.

2. The composition according to claim 1, wherein said colorant is a red pigment.

3. The composition according to claim 1, wherein said colorant is a green pigment.

4. The composition according to claim 1, wherein said alkali metal phsophate detergent builder salt is sodium tripolyphosphate.

5. The composition according to claim 1, wherein said alkali metal nonphosphate detergent builder salt is sodium carbonate.

6. The composition according to claim 1, further including a protease enzyme and an amylase enzyme in a weight ratio of 10:1 to 1:10.

7. The composition according to claim 1, further including a chlorine bleach.

* * * * *